US005878444A

United States Patent [19]

Convoy

[11] Patent Number: 5,878,444

[45] Date of Patent: Mar. 9, 1999

[54] TOILET SEAT

[75] Inventor: Terence Paul Convoy, Harlow, United Kingdom

[73] Assignee: T.C. Everdown Limited, United Kingdom

[21] Appl. No.: 999,379

[22] Filed: Dec. 23, 1997

Related U.S. Application Data

[63] Continuation of PCT/GB96/01527, Jun. 25, 1997.

[51] Int. Cl.[6] ..... A47K 13/10

[52] U.S. Cl. ..... 4/246.1; 4/248

[58] Field of Search ..... 4/246.1, 248, 246.2, 4/246.3, 246.4, 246.5

[56] References Cited

U.S. PATENT DOCUMENTS

| | | | |
|---|---|---|---|
| 4,491,989 | 1/1985 | McGrail . | |
| 5,153,946 | 10/1992 | Yoke et al. | 4/246.1 |
| 5,400,442 | 3/1995 | Pendlebury | 4/246.2 |
| 5,546,612 | 8/1996 | Johnson | 4/246.1 |
| 5,570,478 | 11/1996 | Armstrong | 4/246.1 |

FOREIGN PATENT DOCUMENTS

| | | |
|---|---|---|
| PCT/US91/01314 | 2/1991 | WIPO . |
| PCT/US94/12066 | 4/1995 | WIPO . |

*Primary Examiner*—David J. Walczak
*Attorney, Agent, or Firm*—Gregory M. Howison

[57] ABSTRACT

A toilet seat (12) is attached to a toilet bowl (11) by a hinge (9). A lid (14) is also pivoted about a shaft (16) fixed to the seat and forming part of the hinge. A spring (18) acts between the lid and the seat such that, when left in a raised position, the seat is biased towards a lowered position and a catch (21) acts to retain the seat relative to the lid. A proximity detector is arranged to sense when a user moves away from the water closet (10) and is then operable to release the catch to allow movement of the toilet seat from the raised position to the lowered position. The apparatus provides for automatic lowering of the seat and is constructed in a compact manner which contains the essential components within a hollow base portion (15) of the lid.

4 Claims, 5 Drawing Sheets

TOILET SEAT

This application is a continuation of PCT Application No. PCT/GB96/01527, filed Jun. 25, 1996.

The present invention relates to toilet seat apparatus and in particular to apparatus in which the lowering of a toilet seat is provided automatically.

Arrangements have been proposed in the past for lowering the seat of a toilet automatically. These have included arrangements which push the raised seat so that it falls under gravity a predetermined time interval after it has been raised, and arrangements which cause the seat to be lowered in response to operation of a flushing handle of a water closet to which the seat is fitted. However in practice, the times at which these arrangements lower the seat are often inappropriate.

It is also known from WO 95/10971 to provide an arrangement including a proximity detector arranged to sense when a user moves away from the water closet and to cause the toilet seat to move from the raised position to its lowered position by means of a spring and spring locking mechanism. A disadvantage of this arrangement is that it provides relatively bulky hinge housings to be fitted to the water closet in order to accommodate the spring and spring locking mechanism.

According to the present invention there is disclosed toilet seat apparatus comprising a toilet seat, a lid, a hinge having mountings securable to a water closet and a shaft pivotally connected to the mountings, the shaft being secured to the seat and the lid being pivotal about the shaft such that the lid and seat are movable between raised and lowered positions, spring means operable when the seat and lid are in their raised positions to bias the seat for movement towards the lowered position, a catch operable to retain the seat in the raised position and a proximity detector arranged to sense when a user moves away from the water closet and operable to release the catch thereafter to allow movement of the toilet seat from the raised position to the lowered position, characterised in that the spring means acts between the seat and the lid, wherein the catch is operable to restrain movement of the seat relative to the lid, and wherein the spring means are arranged in a housing located between the mountings.

An advantage of such apparatus is that it is not necessary for the spring means and catch to be located in hinge housings, thereby enabling the apparatus to have a more compact appearance and simplified construction.

Preferably the catch is operable to restrain movement to a limited extent allowing manual separation of the seat from the lid by the user. The user may thereby manually lower the seal without lowering the lid, without relying upon the apparatus automatically lowering the seat. In the event that the user forgets to lower the seat however, the proximity detector will sense when the user has moved away and will release the catch to allow the toilet seat to automatically be lowered.

Preferably the catch comprises a catch member mounted on one or other of the lid and the seat and engagable in a recess defined in a locking member mounted on the other of the seat and the lid, a spring urging the catch member into an engaged position and a solenoid being operable on the spring when actuated to reduce the spring bias acting on the catch member to allow disengagement of the catch member from the recess.

This arrangement avoids damage to the catch member in the event that the user wishes to manually release the catch.

Preferably the catch member is a ball. The apparatus preferably comprises a housing formed integrally with the lid, the catch member being mounted in the housing and the locking member being mounted for rotation with the shaft. In a preferred embodiment, the locking member is in the form of a disc mounted co-axially on the shaft.

The shaft may extend through the housing and the spring means may comprise a coil spring acting in torsion between the shaft and the housing.

This provides a compact construction in which the spring is concealed.

Preferably the proximity sensor is mounted in the housing.

preferably the apparatus comprises a micro-switch operable to de-activate the sensor and solenoid when the seat is in the lowered position. Since the apparatus will in general be battery powered, the use of such a micro-switch enable battery power to be conserved.

Preferably the apparatus comprises damping means operable to damp movement of the toilet seat relative to the hinge mountings. This is important since the spring means acts to initiate movement of the seat from the raised position by a sufficient amount to allow further lowering of the seat to progress under the force of gravity. The damping means is necessary to avoid lowering of the seat occurring at excessive speed and thereby from striking the water closet too abruptly. The damping means may comprise a damping member which frictionally engages the shaft.

A preferred embodiment of this invention will now be described by way of example only and with reference to the accompanying drawings, in which.

Figure 1:
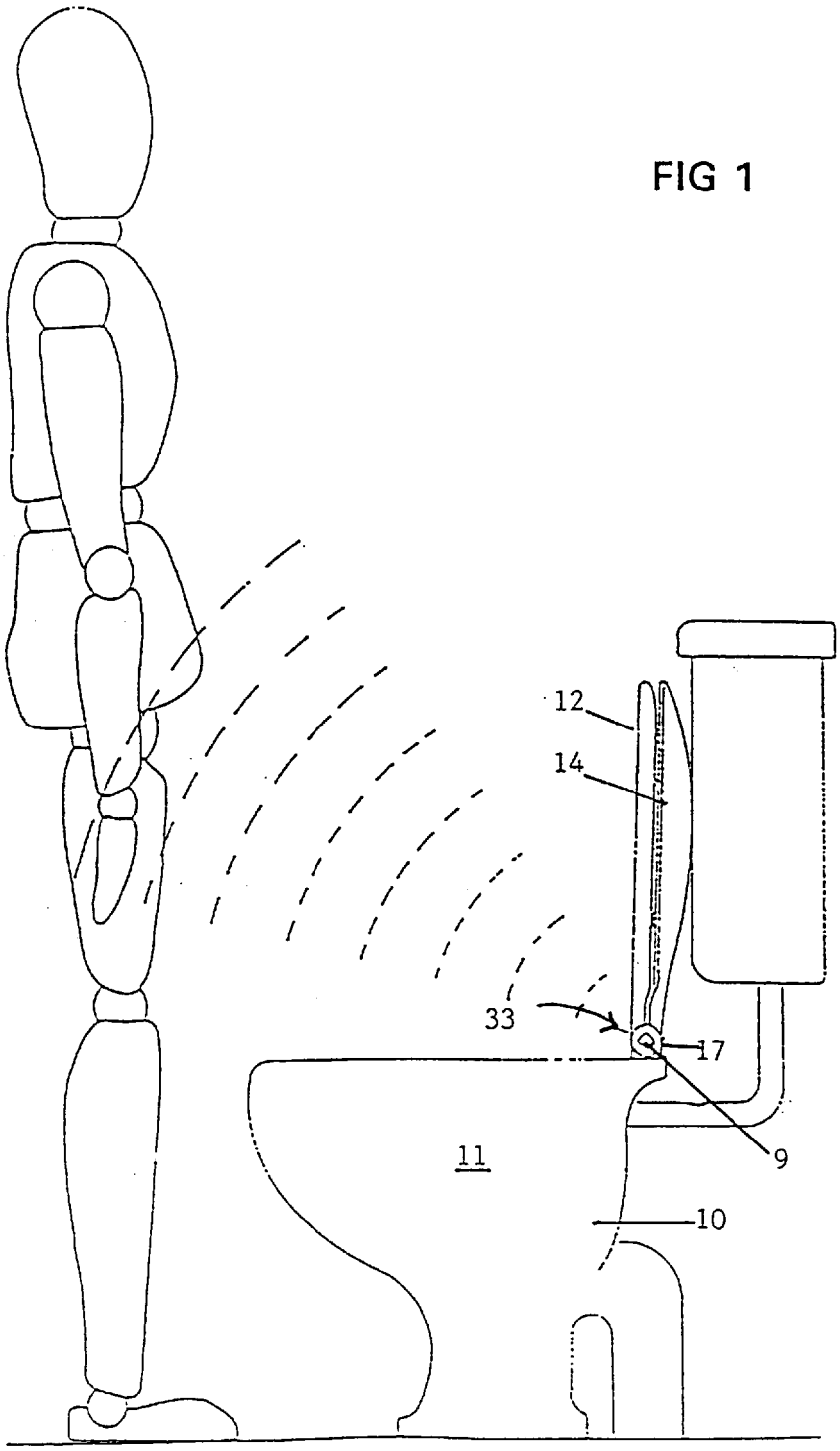
FIG. 1 is a schematic side view of a water closet provided with toilet seat apparatus in accordance with this invention, for lowering the seat automatically.
Figure 2:
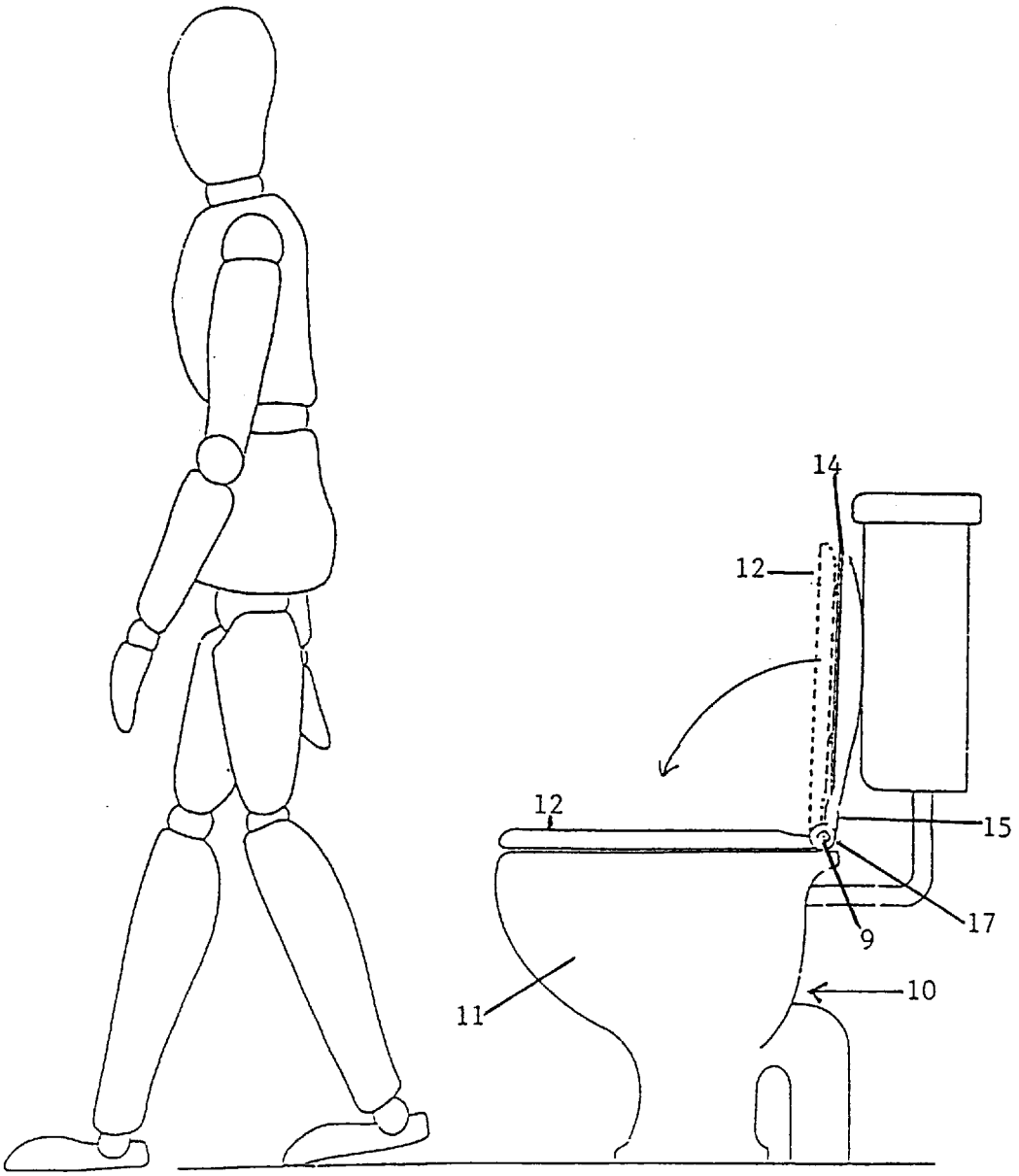
FIG. 2 is a schematic side view of the water closet of FIG. 1, illustrating how the toilet seat lowers automatically when the user moves away.

Referring to FIG. 1, there is shown a water closet 10 having a toilet bowl 11 fitted with a seat 12 and a lid 14, the seat and lid being connected by means of a hinge 9 to a top of the toilet bowl at its rear in conventional manner. FIG. 1 shows both the seat 12 and lid 14 hinged to the raised position. As indicated in FIG. 2, when the user moves away from the water closet, a proximity detector 33, located in the region of the hinge 9, senses this movement and causes the seat 12 to be lowered automatically.

Figure 3:
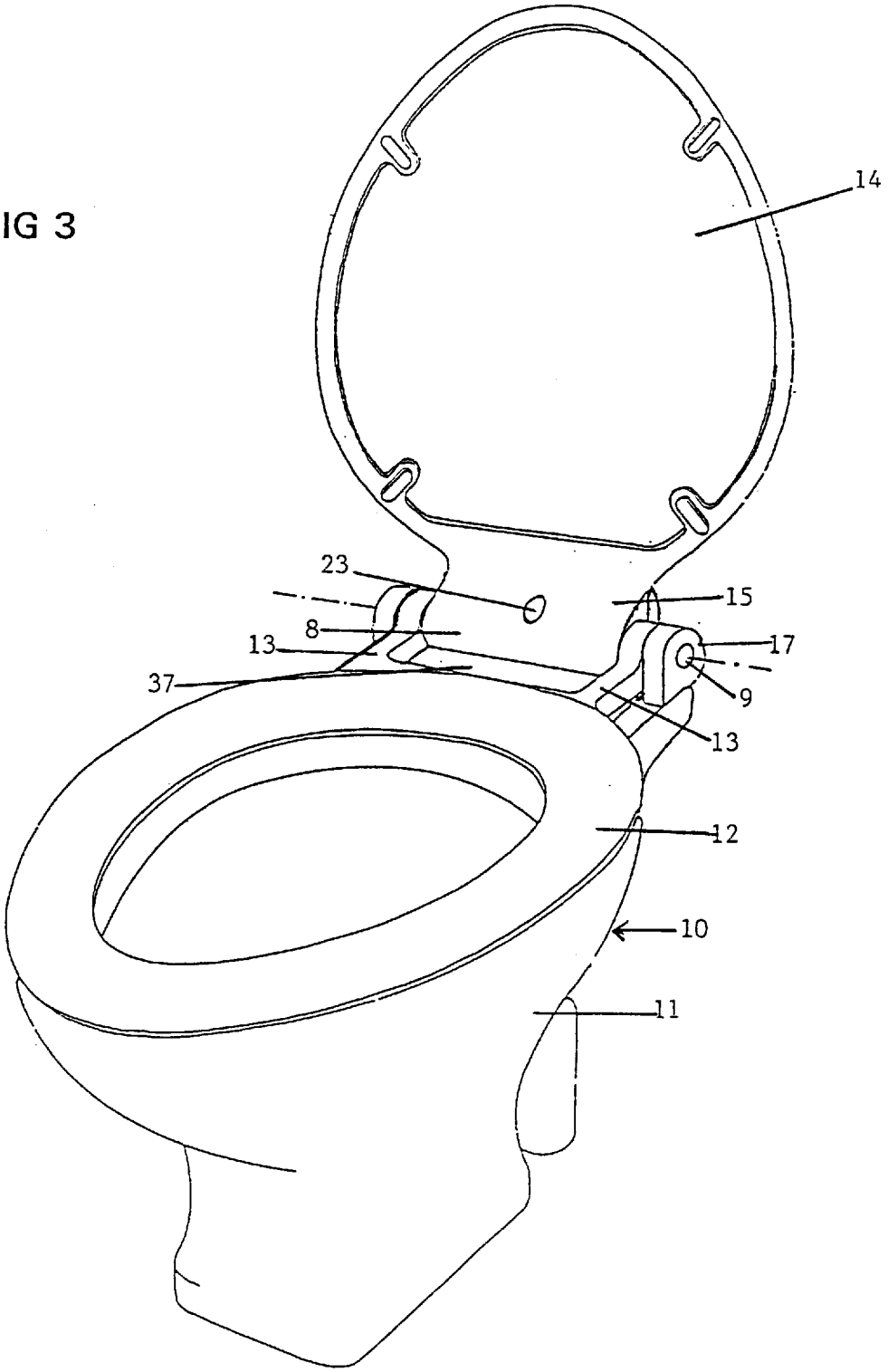
FIG. 3 is an isometric view of the water closet of preceding FIGURES.
Figure 4:
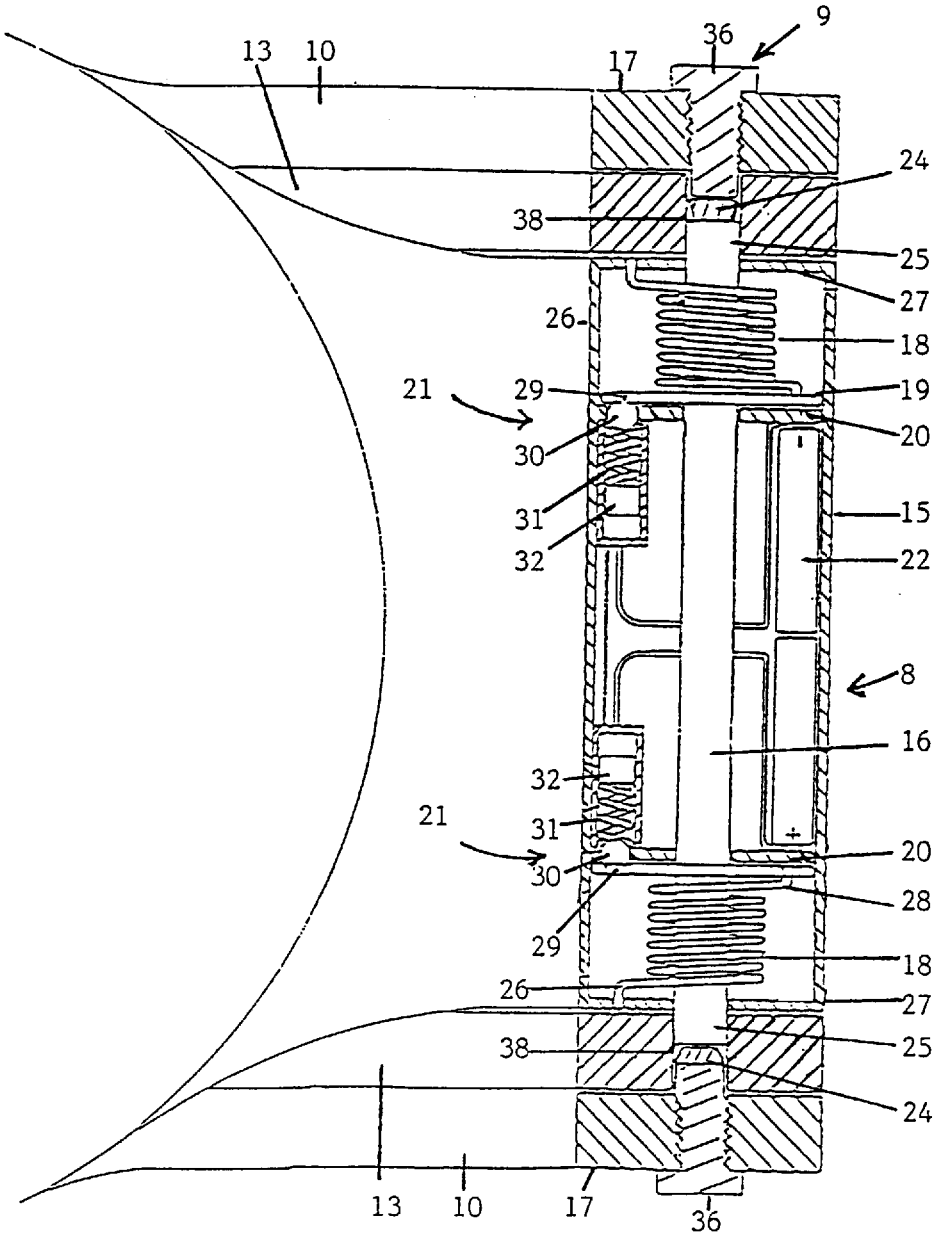
FIG. 4 is a sectional plan view of the toilet seat apparatus of preceding FIGURES with both the seat and lid in a lowered position.

As shown in FIGS. 3 and 4, the automatic lowering arrangement is incorporated in a housing 8 comprising a hollow base portion 15 of the lid 14. A shaft 16 extends through the hollow base portion 15 of the lid 14 and the seat 12 is provided with pivot arms 13 which are fixed to opposite end portions 25 of the shaft 16. Two hinge supports 17 are mounted to the top of the toilet bowl 10 and the end portions 25 of the shaft are pivotally connected to the hinge supports. The lid 14 is pivotally mounted on the shaft 16 and in the raised position as shown in FIGS. 1 and 2 both seat and lid have centres of gravity behind the hinge 9, thereby remaining in a stable near vertical position. Coil springs 18 encircle the shaft 16 adjacent the respective inner ends 27 of the hollow base portion 15 of the lid 14, each coil spring having one end 26 engaged in the associated end 27 of the base portion 15, and its opposite end 28 engaged in a respective disc 19 fixed to the shaft 16. Between two internal partitions 20 of the base portion 15, two solenoid operated catches 21 are mounted, each engaging a recess 29 in the respective disc 19. Each catch 21 comprises a respective solenoid 32 connected in an electric circuit shown in FIG. 5 which is housed in the hollow base portion 15 and powered by dry cell batteries 22. Each catch 21 comprises a ball 30 biased into engagement with the recess 29 by means of a compression spring 31 which is held in compression between the solenoid 32 and the ball 30. The compression spring 31 provides sufficient force such that, when the seat 12 and lid 14 are in the raised position, the ball enters the recess 29 and locks the seat relative to the lid. When the solenoid 32 is actuated, movement of the solenoid releases the compression spring to an extend allowing the disc 19 to rotate and the ball 30 to be retracted in response to spring pressure exerted by the spring 18.

In the absence of actuation of the solenoid 32, a manually applied separating force between the seat 12 and lid 14 will overcome the retaining force provided by the catch 21, the ball 30 being retracted in readiness to engage the recess 29 when the seat and lid are again brought to the same position, i.e. when both seat and lid are in the raised position or both in the lowered position.

Figure 5:
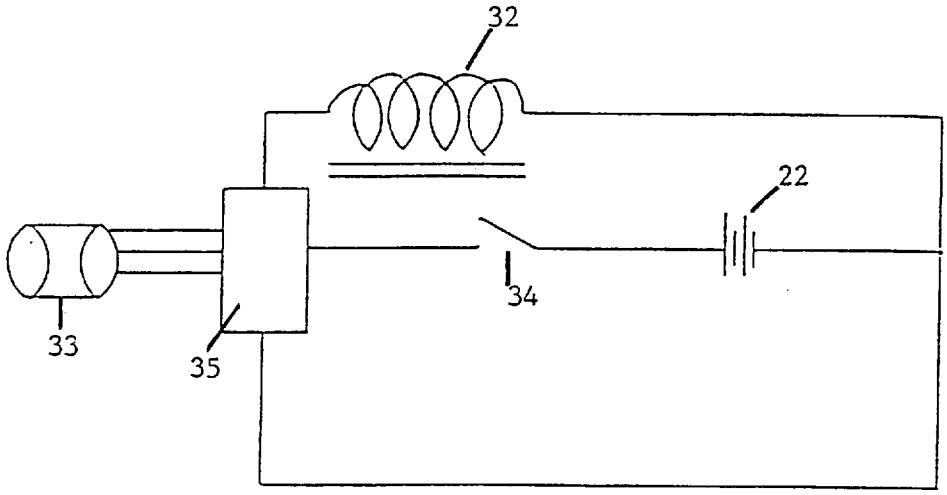
FIG. 5 is a schematic circuit diagram.

FIG. 5 illustrates schematically a circuit for controlling actuation of the solenoid 32. The proximity detector 33 is connected to a control unit 35 and are powered by batteries 22 via a micro-switch 34. The micro-switch 34 is arranged such that the switch is open when the seat 12 is in the lowered position and closed when the seat 12 is in the raised position, thereby energising the detector when the seat is raised.

The control unit 35 energizes the solenoid 32 of each catch 21 in response to the detection of a user having moved away from the vicinity of the proximity detector 33.

The proximity detector 33 is positioned behind a window 23 in the base portion 15 of the lid 14. As seen in FIG. 3, the pivot arms 13 of the seat 12 support the seat in spaced relationship to the housing 8 so as to define an opening 37 therebetween so that, when the seat is in the raised position, a line of sight is established between the window 23 and the user.

The proximity detector 33 is a passive infrared detector which responds to the thermal image of the user in known manner.

Damping of the motion of the seat 12 during movement towards the lowered position is provided by means of rubber damping members 24 which are held in compression between the end portions 25 of the shaft 16 and bolts 36 received in threaded apertures in the hinge supports 17. The bolts 36 also project within bores 38 defined in the pivot arms 13, thereby acting as pivots for the pivotal movement of the seat 12. The bores 38 also receive the end portions 25 of the shaft 16 in fixed relationship such that the shaft 16 and the seat 12 are rotatable in unison. The shaft 16 is therefore seen to be indirectly connected to the hinge supports by means of the pivot arms 13 and the bolts 36.

The bolts 36 may be utilised to adjust the extent to which the damping members 24 are compressed, thereby providing a means of adjusting the extent to which motion is damped.

In use, if the lid 14 is already raised and the seat 12 is in the lowered position, then as the seat 12 is raised, the springs 18 will become loaded, by rotation of the seat 12, shaft 16 and discs 19 relative to the stationary base portion 15 of the raised lid. In the fully raised position of the seat 12, the recesses 29 in the discs 19 align with the spring-loaded balls 30 of the solenoid operated catches 21 and the seat becomes latched to the lid 14 in the raised position. Raising of the seat from the lowered position closes the micro-switch 34, thereby energizing the proximity detector 33. The proximity detector 33 senses when the user moves away from the water closet so that the solenoids 33 are then operated to release the balls 30 from engagement with the discs 19 which are fixed to the shaft 16. The springs 18 act to bias the seat 12 away from the lid 14, resulting in movement of the seat towards its lowered position. As the seat passes through a vertical to a progressively more horizontal position, the center of gravity of the seat moves forward to the hinge 9 and the weight of the seat will then result in a turning moment about the hinge in a direction towards the lowered position. This movement is damped by members 24 which act on the end portions 25 of the shaft 16 and provide frictional damping.

It will be appreciated that if both the lid and seat are initially in the lowered position, the springs 18 at this time will be in their loaded condition. If the lid is then raised on its own, the loading will be removed from the springs; but when the seat is subsequently lifted, the springs will become loaded again, as described above.

Toilet seat apparatus in accordance with the present invention may include alternative forms of damping means, such as for example a frictional brake acting circumferentially on the shaft.

A single catch mechanism may be provided in place of the pair of left and right handed catches described above in the preferred embodiment.

Alternative forms of proximity sensor may be used, such as for example active optical or ultrasonic sensors.

I claim:

1. Toilet seat apparatus comprising a toilet seat (12), a lid (14), a hinge (9) having mountings (17) securable to a water closet (10) and a shaft (16) pivotally connected to the mountings, the shaft being secured to the seat and the lid being pivotal about the shaft such that the lid and seat are movable between raised and lowered positions, spring means (18) operable when the seat and lid are in their raised positions to bias the seat for movement towards the lowered position, a catch (21) operable to retain the seat in the raised position and a proximity detector (33) arranged to sense when a user moves away from the water closet and operable to release the catch thereafter to allow movement of the toilet seat from the raised position to the lowered position, characterized in that the spring means acts between the seat and the lid, wherein the catch is operable to restrain movement of the seat relative to the lid, and wherein the spring means (18) are arranged in a housing (18) located between the mountings (17).

2. Toilet seat apparatus as claimed in claim 1 wherein the catch is operable to restrain movement to a limited extend allowing manual separation of the seat from the lid by the user.

3. Toilet seat apparatus as claimed in claim 2 wherein the catch comprises a catch member (30) mounted on one or other of the lid and the seat and engagable in a recess (29) defined in a locking member (19) mounted on the other of the seat and the lid, a spring (31) urging the catch member into an engaged position and a solenoid (32) operable on the spring when actuated to reduce the spring bias acting on the catch member to allow disengagement of the catch member from the recess.

4. Toilet seat apparatus as claimed in claim 3 wherein the catch member is a ball (30).

* * * * *